US010418153B2

(12) United States Patent
Blaich et al.

(10) Patent No.: US 10,418,153 B2
(45) Date of Patent: Sep. 17, 2019

(54) FABRICATABLE DATA TRANSMISSION CABLE

(71) Applicant: Siemens Aktiengesellschaft, Munich (DE)

(72) Inventors: Wolfgang Blaich, Ettlingen (DE); Micheal Kasper, Nuremberg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/761,227

(22) PCT Filed: Aug. 25, 2016

(86) PCT No.: PCT/EP2016/070045
§ 371 (c)(1),
(2) Date: Mar. 19, 2018

(87) PCT Pub. No.: WO2017/050518
PCT Pub. Date: Mar. 30, 2017

(65) Prior Publication Data

US 2018/0261358 A1 Sep. 13, 2018

(30) Foreign Application Priority Data

Sep. 25, 2015 (EP) ..... 15186837

(51) Int. Cl.
*H01B 11/04* (2006.01)
*H01B 11/00* (2006.01)
(Continued)

(52) U.S. Cl.
CPC ..... *H01B 11/002* (2013.01); *H01B 3/44* (2013.01); *H01B 7/1895* (2013.01); *H01B 11/06* (2013.01)

(58) Field of Classification Search
CPC ..... H01B 11/04; H01B 11/06
(Continued)

(56) References Cited

U.S. PATENT DOCUMENTS 4,110,554 A * 8/1978 Moore ..... D07B 1/147 174/101.5
5,015,800 A * 5/1991 Vaupotic ..... H01B 11/002 156/51

(Continued)

FOREIGN PATENT DOCUMENTS

CN 201122460 Y 9/2008
CN 202632836 U 12/2012

(Continued)

OTHER PUBLICATIONS

PCT International Search Report and Written Opinion of International Searching Authority dated Nov. 8, 2016 corresponding to PCT International Application PCT/EP2016/070045 filed Aug. 25, 2016.

(Continued)

*Primary Examiner* — Chau N Nguyen
(74) *Attorney, Agent, or Firm* — Cozen O'Connor

(57) ABSTRACT

A data transmission cable which can be fabricated includes a plurality of pairs of cores that each comprise a pair of twisted together cores, a central filler which is surrounded by the pairs of cores and bears against the pairs of cores, where the pairs of cores are aligned with one another via the central filler, and a plurality of bundles of filler threads are also arranged equidistantly in the circumferential direction around the pairs of cores, and where each bundle of filler threads is arranged to bear against two pairs of cores that are respectively adjacent to one another such that the pairs of cores are affixed to one another firstly by the central filler and secondly by the bundles of filler threads.

12 Claims, 1 Drawing Sheet

(51) Int. Cl.
*H01B 7/18* (2006.01)
*H01B 11/06* (2006.01)
*H01B 3/44* (2006.01)

(58) Field of Classification Search
USPC ..... 174/113 R, 116
See application file for complete search history.

(56) References Cited

U.S. PATENT DOCUMENTS

| | | | | |
|---|---|---|---|---|
| 6,300,573 | B1 * | 10/2001 | Horie | H01B 7/1895 174/113 C |
| 6,452,107 | B1 * | 9/2002 | Kebabjian | H01B 11/002 174/113 R |
| 6,812,401 | B2 * | 11/2004 | Karrmann | H01B 7/0233 174/113 C |
| 6,984,788 | B2 * | 1/2006 | Grogl | H01B 7/1895 174/106 R |
| 8,546,693 | B2 | 10/2013 | Gromoko et al. | |
| 9,093,195 | B1 * | 7/2015 | Kummer | H01B 7/185 |
| 2012/0031643 | A1 | 2/2012 | Gromko et al. | |

FOREIGN PATENT DOCUMENTS

| | | |
|---|---|---|
| DE | 102004047384 | 1/2006 |
| EP | 0828259 | 3/1998 |
| EP | 2439751 | 4/2012 |
| EP | 2800105 | 11/2014 |
| WO | WO99/60578 | 11/1999 |

OTHER PUBLICATIONS

Office Action dated Aug. 15, 2018 issued in Chinese Patent Application No. 201680053647.8.

* cited by examiner

FABRICATABLE DATA TRANSMISSION CABLE

CROSS-REFERENCE TO RELATED APPLICATIONS

This is a U.S. national stage of application No. PCT/EP2016/070045 filed Aug. 25, 2016. Priority is claimed on EP Application No. 15186837 filed Sep. 25, 2015, the content of which is incorporated herein by reference in its entirety.

BACKGROUND OF THE INVENTION

1. Field of the Invention

The invention relates to transmission cables and, more particularly, to a customizable data transmission cable.

2. Description of the Related Art

Cables that comprise twisted core pairs (twisted pair cables) are frequently used to transmit data and news items, where the cores of these cables are each twisted in pairs with one another. Twisted core pairs render it possible to improve the compensation for any influence from external magnetic alternating fields and electrostatic fields in comparison to core pairs comprising cores that only extend in a parallel manner. As a result of the cores in a core pair being twisted with one another, influences caused by external electromagnetic fields cancel one another out as far as possible. The extent to which the core pairs that are arranged within a cable are twisted may vary and they may rotate in a different direction. Cross-talk between adjacent core pairs in one cable is reduced by virtue of varying the extent to which the cores are twisted. Additional protection against disturbing electromagnetic fields is provided by electrically conductive shields that each surround a twisted core pair in an essentially concentric manner.

EP 0 828 259 A2 discloses a data cable that has at least one twin line comprising a core pair that is configured from two individual cores that are twisted with one another and each comprise a conductor and a core insulation that encompasses the conductor. An intermediate sheath that surrounds the core pair and a shielding arrangement that surrounds the intermediate sheath are also provided. The intermediate sheath fills out the grooves between the surfaces of the individual cores of the core pair at least in part with the result that the geometry of the twin line is fixed.

A cable that comprises at least one pair of insulated cores is described in WO 99/60578 A1. A first separating layer is placed around the core insulation. An inner sheath is placed around the first separating layer without forming a hollow space such that a construction is formed that has an outer contour with a circular cross-section. Finally, a shield braid and an outer cable sheath are placed in an annular manner around the inner sheath.

EP 2 439 751 A2 discloses a data transmission cable having a plurality of core pairs that are each shielded separately and are each surrounded by an axially segmented shielding arrangement. The shielding arrangement comprises numerous segments that are applied to a dielectric substrate that is, for example, extruded over a core pair. The substrate may be configured, for example, from a non-conductive material and may comprise interwoven or non-interwoven fiber glass strands that render the shielding arrangement relatively rigid. Furthermore, the core pairs that are each surrounded by a separate shielding arrangement are encased by a common outer shielding arrangement that is surrounded in turn by an outer sheath.

EP 2 800 105 A1 relates to a data transmission cable that may be modified rapidly and comprises a plurality of core pairs that are each shielded separately and are each embedded in a first insulating filling mass. Moreover, each core pair is provided with a shielding arrangement that encases the first insulating filling mass. All the core pairs are surrounded by an outer braid shield that surrounds a second insulating filling mass in which the core pairs are embedded. The braid shield is in turn encased by an outer sheath of the data transmission cable.

DE 10 2004 047384 B3 describes a cable for transmitting electrical signals, where the cable comprises at least two pairs of cores that lie adjacent to one another. Each core is insulated. The cable also comprises an electrically conductive dividing element that divides the inner cross-section of the cable into a number of open grooves that corresponds to the number of core pairs and one core pair is arranged in each groove in the cable. The core pairs and the dividing element are encased by a cable shield in an essentially annular manner. An electrical contact is produced between the cable shield and the outer edges of the dividing element. Furthermore, an outer cable sheath is placed in an essentially annular manner around the shield.

Cables that are able to be connected or customized rapidly render it possible to strip a section of a cable outer sheath and simultaneously to strip a section of the braid shield at intervals that are offset in an approximately 5 mm manner, said shield braid being surrounded by the cable outer sheath. For this purpose, the outer sheath and the braid shield are ideally uniform. Cables that are able to be connected or customized rapidly render it possible in particular to fulfill the requirements in accordance with International Organization for Standardization/International Electrotechnical Commission (ISO/IEC) 11801-2002, category 6 (Cat-6) standard. It is also possible via a central synthetic material cross, which is used for fixing a core pair in position, to reduce any cross-talk between the core pairs. Consequently, it is possible to realize Cat-6-cables having a SF/UTP construction (Screened foiled, unshielded twisted pair) that comprise an outer braid shield and a foiled shield and also core pairs having non-shielded twisted cores. A synthetic material cross has the disadvantage that it has to be spliced very close to the line end after stripping a section of the cable outer sheath and a section of the braid shield. This is very complex or difficult in particular when a cable is being customized at the place at which the respective cable is to be used.

SUMMARY OF THE INVENTION

In view of the foregoing, it is therefore an object of the present invention to provide a data transmission cable that comprises a plurality of core pairs, in particular having a Screened Foiled, Unshielded Twisted Pair (SF/UTP) construction, and that fulfills the requirements in accordance with the ISO/IEC 11801-2002, category 6 standard and may be customized in a simple manner.

This and other objects and advantages are achieved in accordance with the invention by a customizable data transmission cable that comprises a plurality of core pairs that each comprise a pair of cores that are twisted with one another. In addition, a central supporting element is provided that is surrounded by the core pairs and lies against these core pairs, and the central supporting element orients the core pairs with respect to one another. Moreover, a plurality of bundles of supporting element threads is arranged spaced apart equally in the peripheral direction around the core pairs. Each bundle of supporting element threads is arranged adjacent to two respective core pairs that are adjacent to one another. The core pairs are fixed in position with respect to one another, on the one hand, via the central supporting element and, on the other hand, via the bundles of supporting element threads.

Furthermore, the data transmission cable in accordance with the invention comprises an inner sheath, which encases the bundles of supporting element threads and the core pairs, and a braid shield that surrounds the inner sheath. Furthermore, a data transmission cable that comprises an outer sheath that encases the braid shield is provided. As a result of providing the central supporting element and of arranging the bundles of supporting element threads around the core pairs, it is possible to forego an inner separating element in the shape of a cross, with the result that the data transmission cable may be customized in a simple manner. In particular, the central supporting element and the bundles of supporting element threads may be spliced in a simple manner after stripping a section of the outer sheath and a section of the braid shield.

The core pairs may, for example, each comprise a separate shielding arrangement. Here, the shielding arrangement of the core pairs may be formed by an aluminum foil, a metal braid, in particular a copper braid, or an aluminum-covered synthetic material foil. Moreover, each of the core pairs may be embedded in an insulating filling mass that is surrounded by the shielding arrangement of the respective core pair.

In accordance with one advantageous embodiment of the present invention, the central supporting element or rather the threads of the central supporting element is/are configured from polyvinyl chloride, polyethylene or aramid. The braid shield may be configured, for example, from copper or aluminum. It is preferred that the braid shield is surrounded by an insulating foil. It is consequently possible using SF/UTP structural-design technology to realize data transmission cables that may be customized in a simple manner. The outer sheath in accordance with a further embodiment of the data transmission cable in accordance with the invention is configured from polyvinyl chloride, polyethylene or aramid.

Furthermore, the data transmission cable in a preferred embodiment is configured as a cat-6 cable in accordance with ISO-IEC 11801 and comprises 4 core pairs. Here, 4 bundles of supporting element threads are provided.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The present invention is further explained below with reference to an exemplary embodiment and with the aid of the drawing, in which.

DETAILED DESCRIPTION OF THE EXEMPLARY EMBODIMENTS

Figure 1:
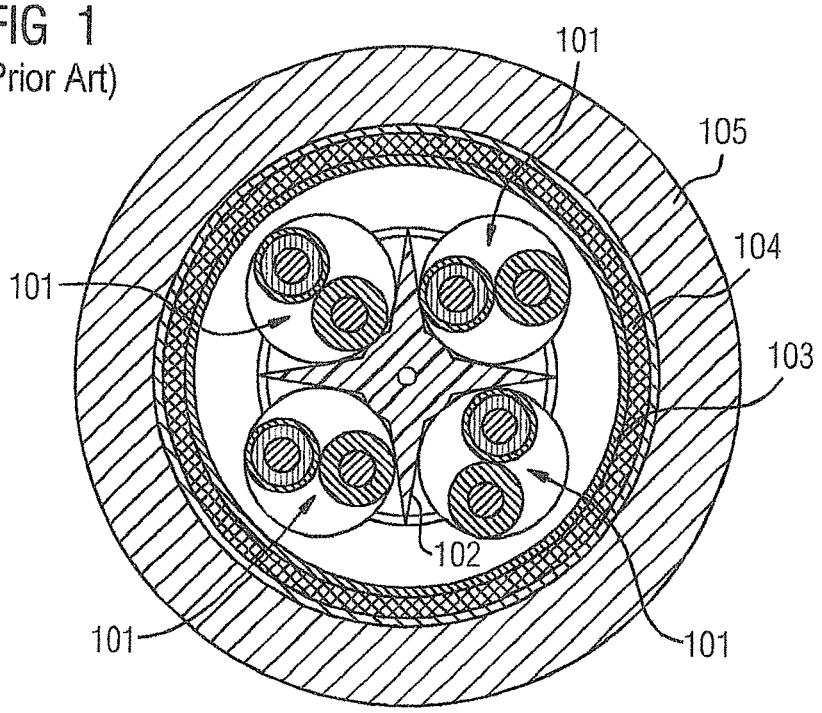
FIG 1 (Prior Art)
FIG. 1 illustrates a cross-section through a conventional data transmission cable that comprises an inner separating element in the shape of a cross.

The data transmission cable illustrated in FIG. 1 is configured in accordance with ISO/IEC 11801-2002 and comprises a plurality of core pairs 101 having twisted, non-shielded cores. The core pairs 101 are fixed in position with respect to one another in a defined spacing via an inner synthetic material separating element 102 that is cross-shaped. The individual core pairs 101 are each arranged in a groove of the synthetic material separating element 102. The defined spacing between the core pairs 101 reduces in particular any cross-talk between the core pairs 101. All the core pairs 101 and the synthetic material separating element 102 are surrounded in a radial manner by an inner sheath 103 that is in turn encased by a braid shield 104. The braid shield 104 is in turn surrounded by an outer sheath 105 of the data transmission cable.

The data transmission cable that is illustrated in FIG. 1 does in fact render it possible to strip a section of the outer sheath 105 and at the same time to strip a section of the braid shield 104 at intervals that are offset by approximately 5 mm. However, it is necessary to splice the synthetic material separating element 102 close to the line end using a separate tool after stripping a section of the outer sheath 105 and a section of the braid shield 104. It is therefore not possible to rapidly customize the conventional data transmission cable illustrated in FIG. 1. In other words, it is difficult to customize the cable at the respective place of use and at the same time it is not very practical with respect to the adjustments required at the respective place of use when guiding through an already pre-customized cable.

Figure 2:
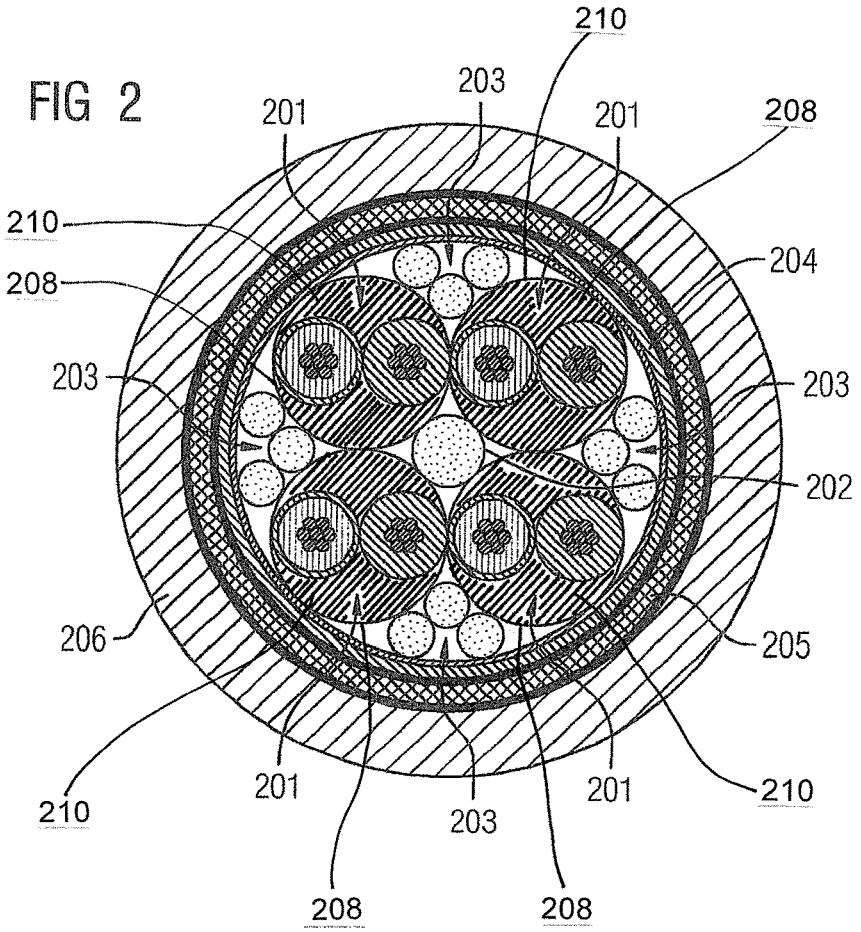
FIG. 2 illustrates a cross-section through a data transmission cable that comprises a central supporting element and a plurality of bundles of supporting element threads in accordance with the invention.

For the above reasons, a synthetic material separating element is not provided in the case of the data transmission cable that is illustrated in FIG. 2. This data transmission cable in the present exemplary embodiment is configured as a cat-6A cable in accordance with ISO/IEC 11801 and comprises 4 core pairs 201 that each comprise a pair of cores that are twisted with one another. Furthermore, a central supporting element 202 is provided that is surrounded by the core pairs 201 and lies against the core pairs, and the central supporting element 202 orients the core pairs 201 with respect to one another. The central supporting element 202 acts as a position fixing element together with the total 4 bundles 203 of supporting element threads that are arranged offset with respect to one another in the peripheral direction in each case by 90° around the core pairs 201. The central supporting element 202 and the supporting element threads may be configured, for example, from polyvinyl chloride, polyethylene or aramid. Each bundle 203 of supporting element threads is arranged lying against two respective core pairs 201 that are adjacent to one another. Consequently, the core pairs 201 are fixed with respect to one another, on the one hand, by the central supporting element 202 and, on the other hand, by the bundles 203 of supporting threads. In this manner, it thus is possible to forego a synthetic material separating element between the core pairs 201.

An inner sheath 204 that is configured from an insulating material and encases the core pairs 201 and the bundles 203 of supporting element threads acts as an additional fixing element for the core pairs 201. The inner sheath 204 is surrounded by a braid shield 205 that is configured, for example, from copper or aluminum and in turn is surrounded by an insulating foil. The foiled braid shield 205 is finally encased by an outer sheath 206 of the data transmission cable. The outer sheath is preferably configured from a polyvinyl chloride, polyethylene or aramid.

Fundamentally, the core pairs 201 may each comprise a separate shielding arrangement 208 that is formed, for example, by an aluminum foil, a metal braid, in particular a copper braid, or an aluminum-covered synthetic material foil. In addition, the core pairs 201 may each be embedded in an insulating filling mass 210 that is surrounded by the shielding arrangement 208 of the respective core pair.

In order to strip a section of the data transmission cable that is illustrated in FIG. 2, it is possible, for example, to use the blade cassette, Siemens 6GK1901-1GB01 as a stripping or customizing tool. Initially, a length of line that is to be a stripped of insulation is measured at the stripping tool and the data transmission cable that has a corresponding length is placed in the stripping tool. The stripping tool is subsequently tensioned and rotated repeatedly about its longitudinal axis so as to strip a section of the data transmission cable. As a consequence, a cut is made in the peripheral direction into the outer sheath and the braid shield at positions that are predetermined by the stripping tool. By virtue of a pulling movement of the stripping tool in the longitudinal direction towards the cable end, parts of the outer sheath and braid shield that are to be separated are stripped from the remaining data transmission cable. Subsequently, the cores are revealed and fanned out, with the result that it is possible to cut off the central supporting element 202 and the bundles 203 of supporting element threads. Finally, the section of the data transmission cable that has been stripped is inserted with its cores for customization into the plug connector housing and the housing is locked.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those structures and/or elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A customizable data transmission cable, comprising:

a plurality of core pairs each comprising a pair of cores twisted with one another;

a central supporting element surrounded by the plurality of core pairs and resting against said plurality of core pairs, said central supporting element orienting the plurality of core pairs with respect to one another;

a plurality of bundles of supporting element threads arranged spaced apart equally in a peripheral direction around the plurality of core pairs and extending parallel to the central supporting element, a supporting element thread of each of the plurality of bundles of supporting element threads being arranged directly against two respective core pairs of the plurality of core pairs which are adjacent to one another, and the plurality of core pairs being fixed in position relative to one another on the one hand via the central supporting element and on the other hand via the plurality of bundles of supporting element threads;

an inner sheath which engages the plurality of core pairs and the plurality of bundles of supporting element threads;

a braid shield which surrounds the inner sheath; and an outer sheath of the customizable data transmission cable, said outer sheath encasing the braid shield.

2. The customizable data transmission cable as claimed in claim 1, wherein the plurality of core pairs each comprise a separate shielding arrangement.

3. The customizable data transmission cable as claimed in claim 2, wherein the shielding arrangements of the plurality of core pairs are formed by one of (i) an aluminum foil and (ii) a metal braid.

4. The customizable data transmission cable as claimed in claim 3, wherein each of the plurality of core pairs is embedded in an insulating filling mass that is surrounded by the shielding arrangement of a respective core pair.

5. The customizable data transmission cable as claimed in claim 2, wherein the aluminum foil comprises an aluminum-covered synthetic foil and the metal braid comprises a copper braid.

6. The customizable data transmission cable as claimed in claim 2, wherein each of the plurality of core pairs is embedded in an insulating filling mass that is surrounded by the shielding arrangement of a respective core pair.

7. The customizable data transmission cable as claimed in claim 1, wherein at least one of (i) the central supporting element and (ii) the plurality of supporting element threads is configured from one of (i) polyvinyl chloride, (ii) polyethylene and (iii) aramid.

8. The customizable data transmission cable as claimed in claim 1, wherein the braid shield is configured from one of (i) copper and (ii) aluminum.

9. The customizable data transmission cable as claimed in claim 1, wherein the braid shield is surrounded by an insulating foil.

10. The customizable data transmission cable as claimed in claim 1, wherein the outer sheath is configured from one of (i) polyvinyl chloride, (ii) polyethylene and (iii) aramid.

11. The customizable data transmission cable as claimed in claim 1, wherein the data transmission cable is configured as a cat-6 cable in accordance with International Organization for Standardization/International Electrotechnical Commission (ISO/IEC) standard 11801 and comprises four core pairs; and wherein four bundles of supporting element threads are provided.

12. The customizable data transmission cable as claimed in claim 1, wherein two of each of the plurality of bundles of supporting element threads engage the inner sheath.

* * * * *